US008444397B2

(12) United States Patent
Nemit, Jr. et al.

(10) Patent No.: US 8,444,397 B2
(45) Date of Patent: May 21, 2013

(54) MANUAL SELECTIVE ATTENUATOR

(75) Inventors: Paul Nemit, Jr., Waynesboro, PA (US); Paul A. Huber, Marion, PA (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 13/640,748

(22) PCT Filed: Sep. 7, 2011

(86) PCT No.: PCT/US2011/050602

§ 371 (c)(1), (2), (4) Date: Oct. 12, 2012

(87) PCT Pub. No.: WO2012/039928

PCT Pub. Date: Mar. 29, 2012

(65) Prior Publication Data

US 2013/0028758 A1 Jan. 31, 2013

Related U.S. Application Data

(60) Provisional application No. 61/384,791, filed on Sep. 21, 2010.

(51) Int. Cl.
*F04B 39/00* (2006.01)
*F01N 13/00* (2010.01)

(52) U.S. Cl.
USPC ..... 417/312; 417/543; 181/241

(58) Field of Classification Search
USPC ..... 417/312, 540, 542, 543; 181/241, 181/250, 271
See application file for complete search history.

(56) References Cited

U.S. PATENT DOCUMENTS

| | | | | | |
|---|---|---|---|---|---|
| 2,198,021 | A | * | 4/1940 | Wood | 181/271 |
| 2,936,041 | A | * | 5/1960 | Sharp et al. | 181/206 |
| 4,863,356 | A | * | 9/1989 | Ikeda et al. | 417/269 |
| 5,096,400 | A | * | 3/1992 | Budecker et al. | 417/540 |
| 5,475,189 | A | * | 12/1995 | Field et al. | 181/241 |
| 5,556,265 | A | | 9/1996 | Michiyuki et al. | |
| 5,957,664 | A | * | 9/1999 | Stolz et al. | 417/53 |

(Continued)

FOREIGN PATENT DOCUMENTS

| | | | |
|---|---|---|---|
| DE | 1403460 | A1 | 11/1968 |
| FR | 2659394 | A1 | 9/1991 |

*Primary Examiner* — Devon Kramer
*Assistant Examiner* — Nathan Zollinger
(74) *Attorney, Agent, or Firm* — McNees Wallace & Nurick LLC

(57) ABSTRACT

An attenuating apparatus for use with a positive displacement compressor. The device includes a bore formed in a housing of the compressor, the bore being positioned at an angle to a discharge chamber of the compressor and in fluid communication with the compressor discharge chamber. A plug is positioned within the bore, the plug movable within the bore to a preselected position. The plug has a first end in contact with a gas from the compressor discharge chamber and a second, opposite end being accessible from an exterior of the housing. A seal is positioned between the plug and the bore to seal an interface between the plug and the bore to prevent leakage of a gas from the compressor discharge chamber along the interface. The plug is lockable within the bore at the preselected position. The preselected position of the plug within the bore determines a bore length in fluid communication with the compressor discharge chamber, which attenuates sound from gas pulsations resulting from discharge of compressed gas from the operation of the compressor. The bore and plug are threaded to facilitate the adjustment of the plug within the bore.

20 Claims, 6 Drawing Sheets

U.S. PATENT DOCUMENTS

| | | | | |
|---|---|---|---|---|
| 6,234,758 | B1 * | 5/2001 | Pawelski | 417/26 |
| 6,508,331 | B1 * | 1/2003 | Stuart | 181/250 |
| 7,946,382 | B2 * | 5/2011 | Harris et al. | 181/250 |
| 8,033,359 | B2 * | 10/2011 | Ichikawa et al. | 181/229 |
| 8,096,790 | B2 * | 1/2012 | Sadatomi et al. | 417/540 |
| 2005/0063853 | A1 | 3/2005 | Otte et al. | |
| 2005/0194207 | A1 * | 9/2005 | Nemit et al. | 181/250 |
| 2005/0276711 | A1 * | 12/2005 | Marshall et al. | 417/540 |
| 2006/0275150 | A1 | 12/2006 | Barth | |

* cited by examiner

MANUAL SELECTIVE ATTENUATOR

CROSS REFERENCE TO RELATED APPLICATIONS

This application claims priority to U.S. Provisional Application 61/384,791 filed Sep. 21, 2010, incorporated herein by reference.

FIELD OF THE INVENTION

The present invention is directed to sound attenuation for compressors, and specifically is directed to an attenuating apparatus for a positive displacement compressor.

BACKGROUND OF THE INVENTION

Noise generation due to pressure pulsations is a natural phenomenon in undamped positive displacement compressors used in HVAC systems as well as other applications such as pipeline applications, as discrete volumes of gaseous fluid enter a chamber at a low, suction pressure, are compressed to a high pressure and are then discharged from the chamber at a high discharge pressure. The periodic suction and discharge of the gaseous fluids is a pulsation event that produces a vibration. At certain frequencies, about 20 to 20,000 Hz, these vibrations fall within the audible range for humans and are perceived as noise. Of course, vibrations are readily propagated along the metal surfaces that comprise the pipes, conduits and other equipment through which the gaseous fluid is circulated.

When the periodicity of the vibrations changes, as a result of change in, for example, the speed of operation of the variable speed compressor, the frequency of vibration also changes. Some noise at certain frequencies resulting from the operation of positive displacement compressors may be less annoying than other frequencies. While it is desirable to completely attenuate the noise generated by operation of a positive displacement compressor, sometimes this is not possible. Mufflers are added to either or both the suction side (low pressure side) of the compressor or the discharge side (high pressure side) of the compressor. While mufflers ideally attenuate sound to eliminate noise, in practice mufflers are designed to tune the sound that is propagated so that sound in certain undesirable frequencies, typically the most annoying frequencies, is attenuated. Thus, these mufflers or resonators are designed to target a fixed frequency and cannot be adjusted readily. To change the target frequency, the muffler physically must be removed from the system and physically modified or replaced with a muffler or resonator designed for a different fixed frequency. Physical modifications to a resonator can require removal of the resonator from site and returning it to the manufacturer. The periodicity of vibrations produced by a positive placement compressor is variable and may change with load, which can vary not only from season to season, but also from day to day, depending upon the application. The frequency range attenuated is generally limited. However, mufflers are designed to attenuate predetermined frequencies. Thus, mufflers can become ineffective as the periodicity of vibrations changes with the speed of operation of the compressor. What is desired is an attenuating apparatus that can dampen noise across a range of frequencies and that readily can be adjusted to attenuate noise at preselected frequencies within the range of frequencies, as conditions warrant.

SUMMARY OF THE INVENTION

A manual selective attenuator for use with a positive displacement compressor is set forth herein. The manual selective attenuator is integral with the discharge side of the positive displacement compressor and acts as an adjustable resonator. The adjustable resonator permits an HVAC technician to tune the resonance resulting from operation of the positive displacement compressor at different speeds or under different load conditions. The manual selective attenuator allows the HVAC technician to adjust the volume in a discharge chamber of the compressor so that pulsations produced by the compressor occur at a resonant wavelength of the most undesirable noise frequencies, producing a cancellation effect. In effect, the manual selective attenuator is an active attenuator that enables the HVAC technician to mechanically vary the volume of the discharge cavity, thereby "tuning" the sound produced by the positive displacement compressor.

A manual selective attenuator includes a bore formed in a compressor housing, the bore being positioned at an angle to and in fluid communication with, the compressor discharge chamber. The manual selective attenuator also includes a plug positioned within the bore and movable within the bore to a preselected position. The plug is either capable of being locked or otherwise prevented from inadvertent movement once moved into the preselected position. The manual selective attenuator also is provided with a sealing means to prevent leakage of high pressure gas discharged by the compressor from migrating along the interface between the plug and the bore and escaping into the atmosphere. At least one end of the plug is accessible from the exterior of the housing, the end including means for moving the plug to a preselected position within the bore. The plug positioned within the bore forms a tuning chamber or cavity. As the plug is moved from a first position within the bore at which the tuning chamber has a first volume, to a second position within the bore at which the tuning chamber has a second volume, the resonance characteristics of the sound of the pulsations of the compressed gas discharged into the discharge chamber are modified. When the plug is adjusted within the bore to a preselected position wherein the tuning chamber achieves a volume that resonates the most undesirable sound produced by the compressor discharged at a ¼ wavelength increment (and whole number multiples thereof e.g. ½ wavelength increment), the attenuator will attenuate at least some of the most undesirable sound produced by the compressor discharge, the sound being propagated in the direction of the compressed fluid discharged from the compressor. The tuning chamber acts to cancel, at least partially, the sound produced by the compressor. The manual attenuator may achieve this result in any manner; however, in its simplest form, a technician can achieve this cancellation manually by adjusting the tuning chamber to a position in which sound attenuation is deemed to be at the most acceptable level. The technician may achieve this result using his own auditory faculties, or the technician may employ a sound spectrum analyzer.

An advantage of the present invention is that undesirable noise produced by a positive displacement compressor can be reduced by a trained technician by varying the volume of the discharge cavity without the necessity of deactivating the system in order to access the system interior. The manual selective attenuator permits adjustments from the exterior of the system.

Another advantage of the present invention is that noise in different frequency ranges can be tuned by the manual selective attenuator without having to otherwise replace or alter the installed attenuator. When the frequency ranges of the noise produced by the compressor changes, the manual selective attenuator can be adjusted so that the discharge volume is changed, thereby altering the sound characteristics of the compressor without the need to cease operation of the compressor or replace parts.

Still another advantage of the present invention is that the manual selective attenuator can be utilized while the positive displacement compressor is operating, so there is no need to shut down the system for the modifications produced by the manual selective attenuator.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

A manually adjustable resonator for modifying the vibration characteristics of a positive displacement compressor is set forth herein. Positive displacement compressors include screw compressors, reciprocating compressors and screw compressors. These compressors compress a gas, preferably a refrigerant gas, by introducing a gas from the suction side of the system into a space, mechanically reducing the volume thereby compressing the gas in the working region of the compressor, and then releasing the compressed gas into a discharge chamber on the high pressure side of the system. The flow of gas from the low pressure, suction side, of the system and discharge of compressed gas into the high-pressure side of the system produces gas pulsations. The compressed gas travels downstream along the high pressure side in a direction away from the compressor. The gas pulsations are the primary source of noise in a positive displacement compressor, and the noise is propagated along the piping and other components, which, being metal, are excellent conductors of sound waves. Sound also is propagated by the pulsating gas moving through the system. The frequencies of the sound waves that are produced by the gas pulsations are dependent upon the discharge opening. Unlike previous solutions to the problem of the noise due to gas pulsations, which involve the use of passive sound attenuators, such as mufflers, designed to attenuate a specific frequency or limited range of frequencies by using sound absorption techniques, the manual selective attenuator dampens sound by modifying the volume in the discharge chamber, on the discharge side of the compressor, thereby modifying the characteristics (frequency) of the sound produced by sound cancellation techniques. When properly tuned, the chamber can act as a ¼ wavelength or ½ wavelength resonator of the most unpleasant or obnoxious frequencies, which are usually the high frequency sounds within the audible frequency range for humans. When acting as such a resonator, the tuned chamber acts to cancel, or at least reduce the amplitude of these undesirable frequencies.

Figure 1:
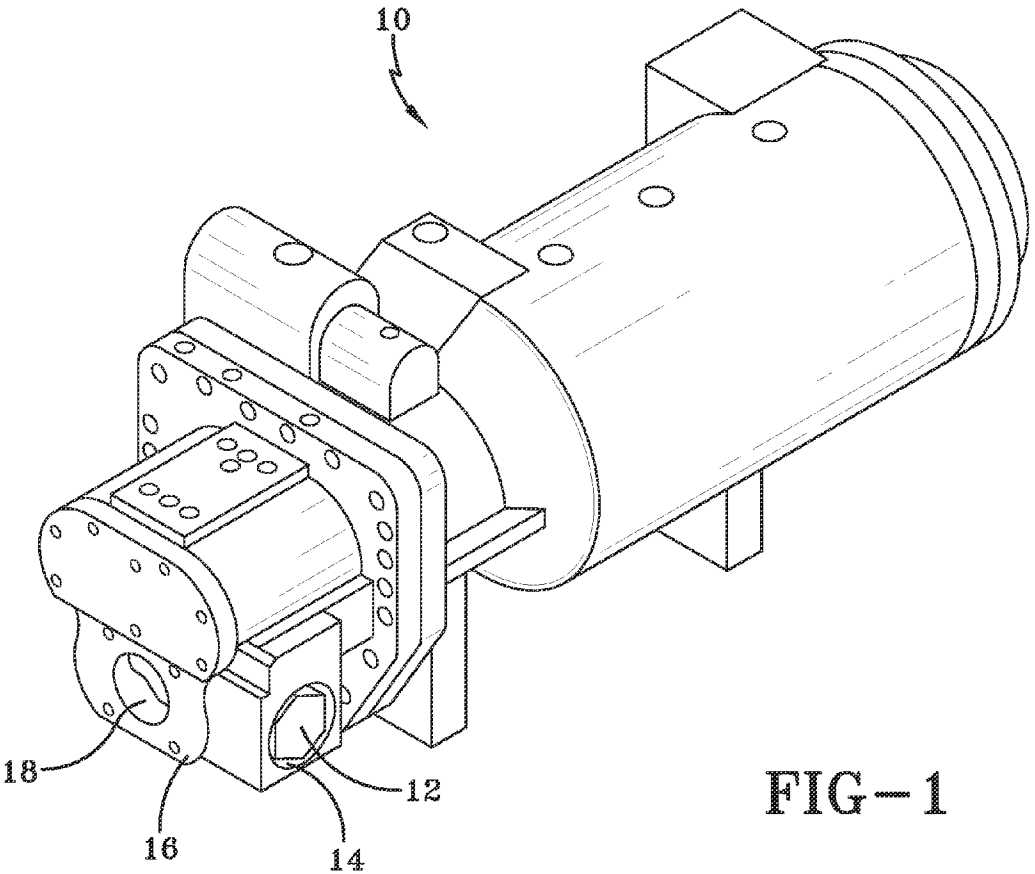
FIG. 1 is a perspective view of a positive displacement compressor.

FIG. 1 provides a perspective view of a screw compressor, which is one type of positive displacement compressor. The exterior surface 12 of manual selective attenuator 14 is visible at the front-end 16 of screw compressor 10. The exterior surface of manual selective attenuator 14 is that portion of the manual selective attenuator that is external to the discharge portion of the system, which is to say, an end that is out of contact with the refrigerant gas and readily accessible to a technician, even as the compression system continues to operate. An opening for a discharge pipe (not shown) that is in communication with the discharge chamber is visible. As noted previously, the positive displacement compressor of FIG. 1 is a screw compressor, but the use of manual selective attenuator 14 is not restricted to use with only a screw compressor, as it may be used with other positive displacement compressors, as will be explained. Positive displacement compressors, as used herein, refer to compressors that tend to maintain a relatively constant volumetric flow rate over a wide range of differential pressures. Positive displacement compressors draw a predetermined volume of vapor into its compression chamber, compressing it to a reduced volume mechanically, thereby increasing the pressure. This maintains the compressor operating near its designed capacity, regardless of the conditions.

Figure 2:
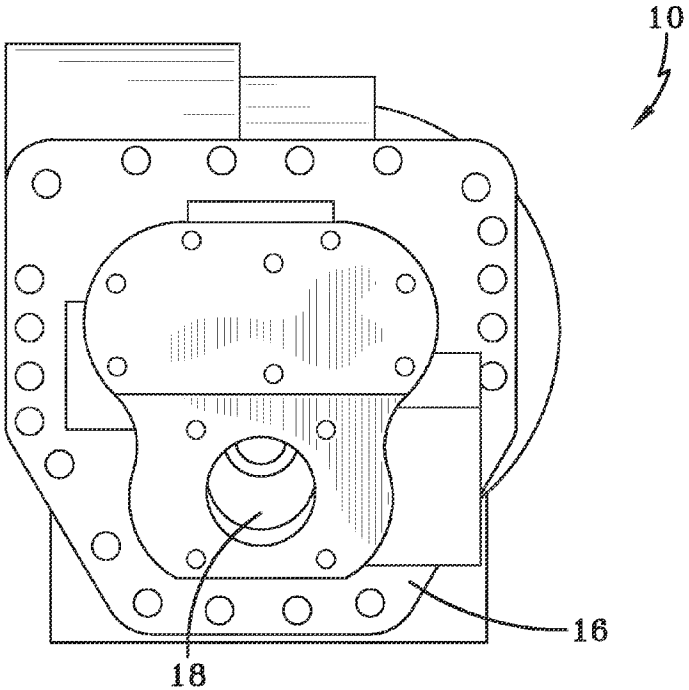
FIG. 2 is a front view of the positive displacement compressor of FIG. 1.

FIG. 2 is a front view of the screw compressor of FIG. 1. In this view, the interior of the discharge chamber is visible through the opening for the discharge pipe.

Figure 3:
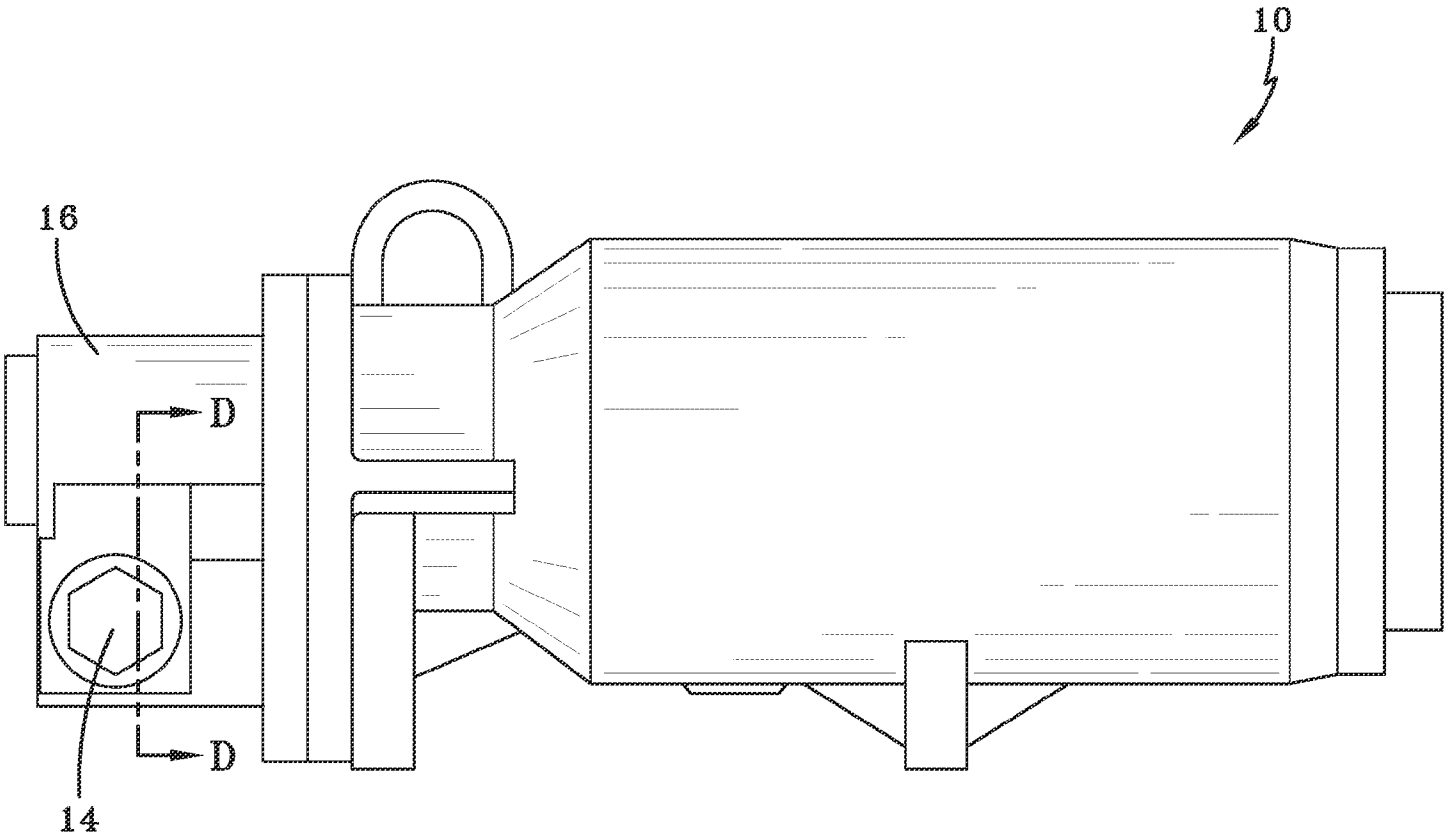
FIG. 3 is a side view of the positive displacement compressor of FIG. 1.

FIG. 3 is a side view of the screw compressor 10 of FIG. 1. In this figure, the preferred orientation of manual selective attenuator 14 with respect to the centerline of the compressor discharge chamber, at about 90°, is evident. However the orientation of manual selective attenuator 14 is not so limited, as any orientation in which the manual selective attenuator can modify the volume of the discharge chamber may be utilized.

Figure 4:
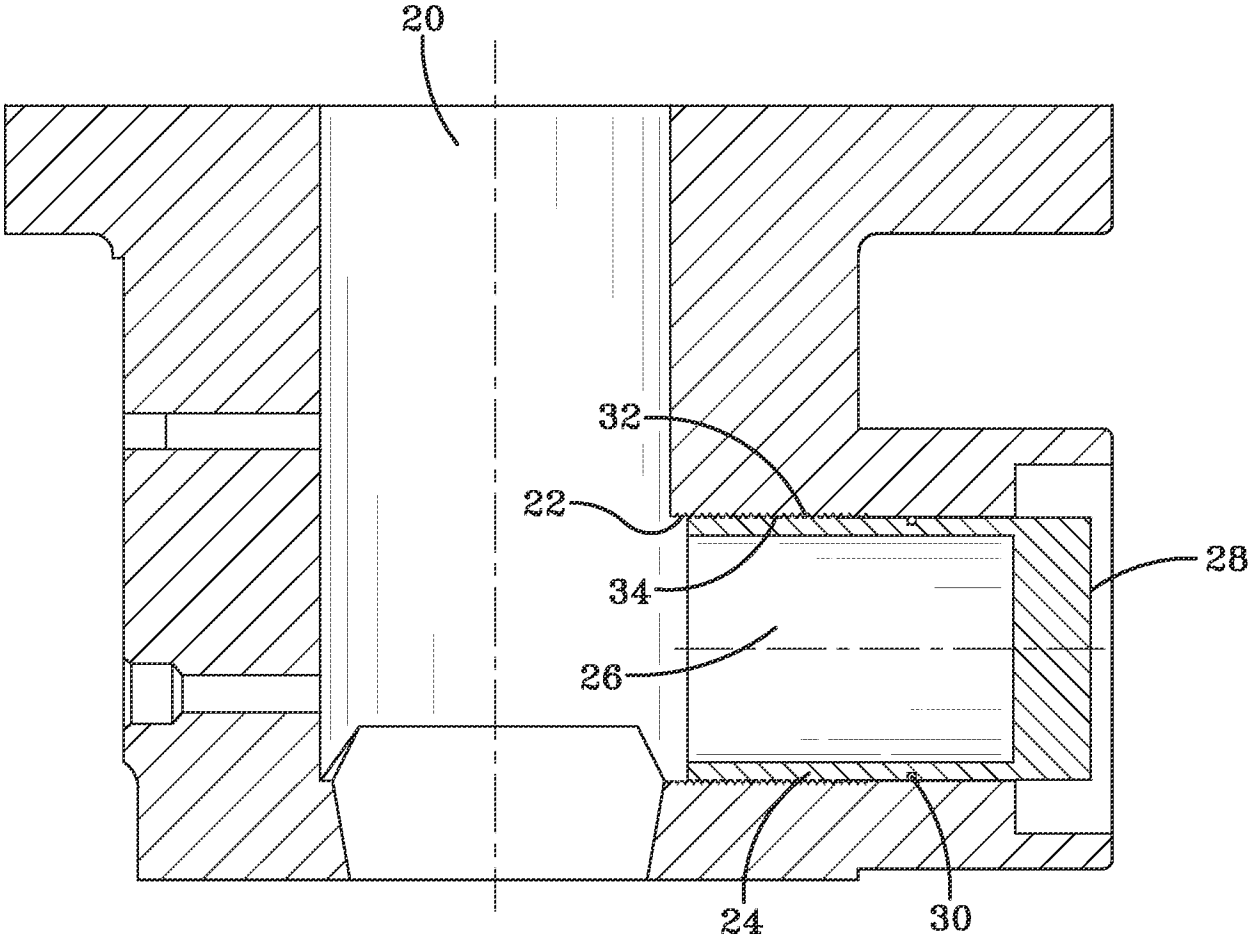
FIG. 4 is a cross-sectional view of the positive displacement compressor of FIG. 1 depicting the discharge cavity and the tubing cavity of a manual selective attenuator of the present invention.

FIG. 4 is a cross-sectional view of the screw compressor of FIG. 1. Compressed refrigerant from the screw (not visible) is discharged into discharge chamber 20, FIG. 5. A bore 22 is positioned at an angle to discharge chamber 20 and in fluid communication with chamber 20. Preferably, bore 22 is normal to discharge chamber 20. Positioned within bore 22 is a plug, when threaded referred to as threaded device 24, that may be moved to a preselected position within bore 22, the position selected based on sound reduction of the sounds caused by gas discharge from the compressor. Preferably, the threaded device includes a separate tuning cavity 26, so that the bore alone is not exclusively the tuning cavity. As shown in FIG. 4, the housing in which bore 22 is formed includes female threads, shown as 3-20 UN-2B threads indicative of the thread size for this application. Threaded device 24 includes mating male threads, shown as 3-20 UN-2A threads, allowing threaded device 24 to be readily movably adjusted within bore 22. It will be understood by those skilled in the art that, when bore 22 and plug 24 are threaded, any thread size suitable for bore 22 and for mating threaded device 24 may be used. The end of tuning cavity 26 opens bore 22 and into discharge chamber 20. The entire volume available for compressor gas discharged from the compressor is the sum of the volume of discharge chamber 20 and tuning chamber 26.

The opposite end 28 of the threaded device 24 extends outside of the pressure boundary of the system, providing plug or threaded device 24 with an exterior surface 12 readily accessible to a technician, so that system operation may continue. Also evident in FIG. 4 is at least one seal 30 positioned between bore 22 and threaded device 24. Preferably, the at least one seal 30 is an O-ring seal that is compatible with the refrigerant used in the compressor, as well as any oil that may be used to facilitate operation of the compressor. Seal 30 is depicted as an o-ring positioned in a groove formed in bore 22. However, seal may also be positioned in a groove formed in plug or threaded device 24. Typical seals include Buna-N rubber seals, neoprene seals and latex seals, although any other material suitable for the purpose may be used. The purpose of the seal is to prevent pressurized refrigerant discharged by the compressor from leaking along the threads and path between threaded device 24 and bore 22. Threaded device 24 positioned in bore 22 and seals 30 comprise the attenuating device which is manual selective attenuator 14. While threaded device 24 is depicted in FIG. 4 as having walls extending toward discharge chamber and assembled into bore 22, the invention also contemplates bore 22 forming a portion of tuning cavity 26. Alternatively, threaded device 24 may not include a tuning cavity 26 as shown in the exemplary embodiments of the figures, the threaded device being, for example a nut or capscrew, assembled into bore 22, with bore 22 solely acting as a tuning cavity.

Figure 5:
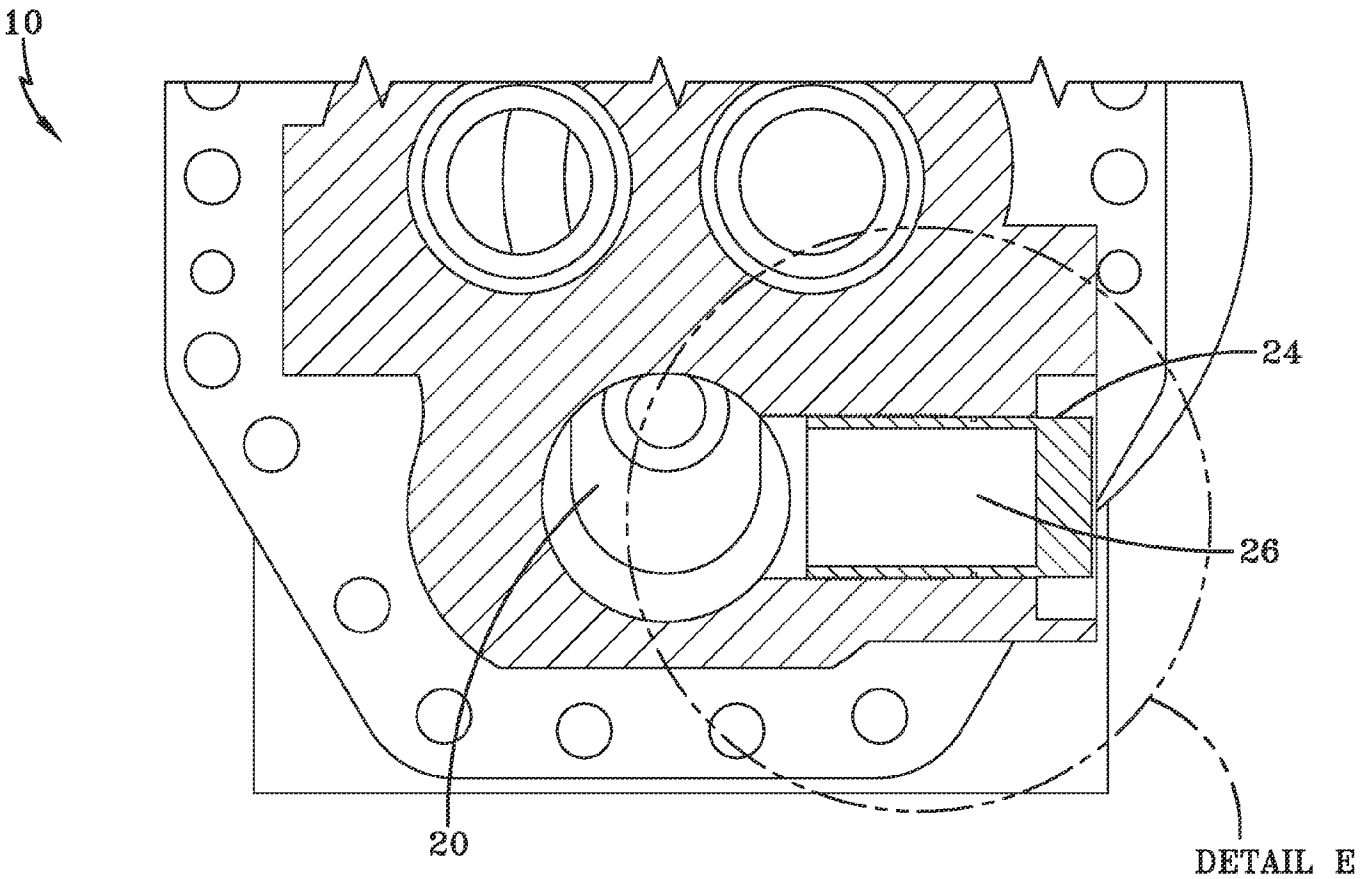
FIG. 5 is a cross-sectional view of the section D-D of FIG. 3.
Figure 6:
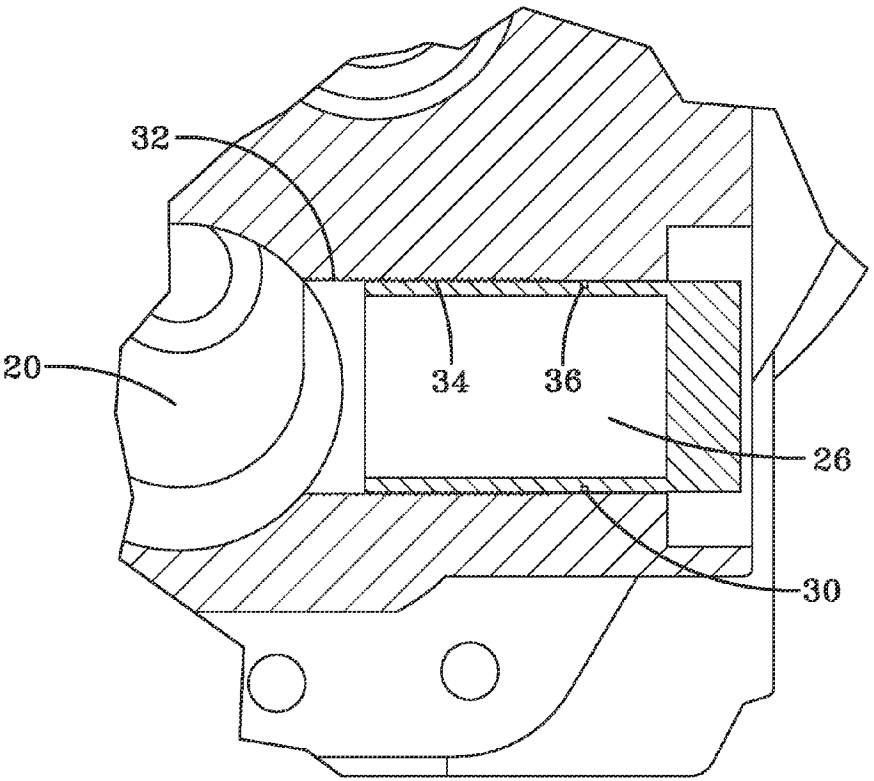
FIG. 6 depicts Detail E of FIG. 5.

FIG. 5 is a cross-sectional view of section D-D of FIG. 3 depicting the relation between manual selective attenuator 14 and discharge chamber 20. FIG. 5 provides a slightly different view than is available in FIG. 2. It depicts the discharge chamber 20, but also shows a cross-section of manual selective attenuator 14, clearly showing in cross-section threaded device 24 with tuning cavity 26 threaded into bore 22. FIG. 6 depicts detail E of FIG. 5. Tuning cavity 26 is in fluid communication with discharge cavity 20. The threads on threaded device 24, identified as 3-20 UN-2A, are external threads 32 that mate with internal threads 34, identified as 3-20 UN-2B, formed in the housing along a portion of bore 22. Seal 30 seals any gaps between threaded device 24 and the housing in which bore 22 is formed, thereby preventing any discharge of refrigerant along the interface between bore 22 and threaded device 24. As previously noted, the thread sizes are exemplary only and may be modified to be larger or smaller to match the size of bore 22 and threaded device 24. A seal groove 36, shown in FIG. 6 formed in threaded device 24, is used to seat o-ring seal 30. However, seal groove also may be formed in bore 22. Internal threads 34 are formed at least partially along bore 22, which limits the amount of travel of threaded device 24 in bore 22. A positive stop, not shown, may be provided to limit the amount of travel of threaded device 24 in the direction of discharge chamber 20 so that threaded device 24 cannot be threaded into discharge chamber 20, thereby blocking the flow of refrigerant in discharge chamber 20. Although FIG. 6 does not show a positive stop, one convenient positive stop is in the form of a flange or similar projection extending outwardly from threaded device 24 on its opposite end 28, which limits the distance that threaded device 24 may be threaded into bore 22. A positive stop may also be provided to limit the distance that threaded device 24 may be threaded out of bore 22. One effective positive stop to limit the travel of threaded device from bore 22 is a groove and spring loaded stop. The spring loaded stop may ride along the outer diameter of threaded device 24. The limit of travel is determined by the placement of the groove. When the limit of travel is reached, the spring loaded stop is urged into the groove, preventing any further outward movement of threaded device 24 with respect to bore 20. Any other arrangements to limit the travel, whether associated with plug or threaded device 24 or bore 22, in either direction may also be used.

In operation, a technician may utilize manual selective attenuator 14 of the present invention to modify the acoustic characteristics of the compressor. As previously noted, a positive displacement compressor generates multiple frequencies. For example, a single screw compressor generally generates low noise. However, oil injection free technology, which has been implemented to eliminate the need for an oil separator in screw compressors, has been the source of increased noise that desirably is eliminated. Variable speed drives may be another source of noise. Here the speed at which the compressor may be driven can vary by the load on the compressor. This load will change based on the circumstances in the space that is being conditioned. As the compressor load changes, the speed at which the compressor is driven changes and the noise that is generated also changes. This usually occurs with changes of season, and it would be desirable to tune out the most disagreeable frequencies. The most disagreeable frequencies are usually the frequencies at the higher end of the sound range, above 5000 Hz to about 22,000 Hz. It should be noted that depending on the individual, the sound range capability of many individuals particularly with increasing age, may be limited to well below 22,000 Hz. It may be that some individuals may not be able to perceive sound above 10,000-12,000 Hz. Nevertheless, it may be necessary for the technician to use the manual selective attenuator to adjust the sound produced by the compressor in the range of, for example, 15,000-22,000 Hz because some portion of the general population that may occupy the space may be capable of hearing sounds in these frequencies generated by the compressor system. In some circumstances, particularly if the hearing capability of the technician is limited, it may be necessary for the technician to use sound spectrum analyzers to properly adjust the unpleasant sounds, particularly at higher frequencies.

Since the frequency of the sound wave is dependent on the volume of discharge chamber 20 plus the volume of tuning cavity 26, this volume can be adjusted, within limits, by adjusting the volume of tuning cavity 26, since the volume of discharge chamber 20 is fixed. The opposite end 28 of threaded device 24 permits the adjustment of the threaded device 24 in bore 22 and hence the volume of tuning cavity 26. This can be done by a technician from the exterior of positive displacement compressor 10 using a means for adjustment that permits the manual selective attenuator 14 to be moved in relation to discharge cavity 20. In the embodiment shown in FIG. 3, manual selective attenuator is provided with a hex head as a means for adjustment. Threaded device 24 may be adjusted into or out of bore 22 by the technician by applying a suitable wrench across the flats of the hex head. However, other means for adjustment may be provided. For example, a slot may be provided in the opposite end 24 of threaded device 24 permitting threaded device to be adjusted with a slotted screwdriver. Alternatively, a keyway, such as a socket, with a predetermined geometry may be provided that requires a key with a mating predetermined geometry. This arrangement allows adjustment to be accomplished by only those having a key with the appropriate geometry. The technician may turn threaded device in one direction or the other until the cavity is a ¼ wavelength resonator, which is to say that the length of the cavity is a ¼ wavelength increment or multiples thereof of the most undesirable sound. This may be accomplished by simple trial and error by the technician, assuming that the technician's hearing is responsive to a wide range of audible frequencies. If not, it may be necessary for the technician to utilize sound analyzers to properly adjust the manual selective attenuator 14 to achieve a desired sound attenuation.

The active manual selective attenuator of the present invention may be provided with additional sound absorption capabilities to further allow for additional controls of frequency response by combining it with passive sound absorptive materials. Passive sound absorptive material can be added to tuning cavity 26 to assist in controlling frequencies above about 400 Hz. The characteristics of passive sound absorptive material include inertness both with respect to the refrigerant used in the compressor as well as any oil that may be utilized for compressor lubrication. Acceptable passive absorptive materials include melamine foam and glass fiber, although passive absorbers are not limited to these two materials. The passive sound absorptive material may be inserted into the tuning cavity of threaded device 24. In this manner, the passive sound absorptive material moves with threaded device 24 as it is moves within bore 22 during tuning operations. Alternatively, the passive sound absorptive material may be placed within bore 22 beyond the travel of threaded device 24 in bore 26. The placement at this location assures that the passive absorptive material cannot inadvertently be moved by threaded device 24 into the discharge cavity. Other combinations of the active absorber of the present invention coupled with passive sound absorptive material to reduce the overall sound generated by the compressor are envisioned.

As shown in the figures above, the active sound attenuator of the present invention is added to the housing of the screw compressor in proximity to the compressor discharge chamber. This may also be accomplished with a reciprocating compressor and with a scroll compressor, when possible. However, in some circumstances, housing for a manual selective attenuator may not be available. In such circumstances, a housing that can accommodate the manual selective attenuator may be attached to the system piping as close to the compressor discharge chamber as possible. Sound propagates along the piping and the frequency of the sound that is propagated can be modified, and thus attenuated, by applying a manual selective attenuator downstream of the discharge chamber of the compressor, although it is preferable to provide the manual selective attenuator adjacent to the discharge cavity and perpendicular to the flow direction of the refrigerant.

In still another arrangement, threaded device 24 may not include a tuning cavity machined into threaded device 24. Instead, threaded device is inserted into bore 22, and tuning cavity 26 is formed by bore 22, as previously discussed. An o-ring seal is provided to seal the gap in the bore between the housing of the positive displacement compressor and the threaded device, the length of tuning cavity being determined by the distance that threaded device is inserted into bore 22.

The figures depict threaded device 24 and bore 22 being partially threaded and engaged with one another along their respective threads. However, the invention is not so limited. Indeed, the entire length of the housing along bore 22 in the housing and some or the entire exterior surface of the threaded device may be threaded, as long as appropriate stops are included to preclude over-travel either out of the housing or inward in the direction of discharge chamber 20 so as to block the flow of refrigerant.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An attenuating apparatus for use with a positive displacement compressor, comprising:

a bore formed in a housing of the compressor, the bore being positioned at an angle to a discharge chamber of the compressor and in fluid communication with the compressor discharge chamber;

a plug positioned within the bore, the plug movable after installation within the bore to a preselected position, the plug having a first end in contact with a gas from the compressor discharge chamber and a second, opposite end being accessible from an exterior of the housing;

a seal positioned between the plug and the bore to seal an interface between the plug and the bore to prevent leakage of the gas from the compressor discharge chamber along the interface;

the plug being lockable within the bore at the preselected position;

wherein the preselected position of the plug within the bore determines a bore length in fluid communication with the compressor discharge chamber, the preselected position of the plug determining the bore length that attenuates sound from gas pulsations resulting from discharge of compressed gas from the operation of the compressor.

2. The attenuating apparatus of claim 1 wherein at least a portion of the bore includes threads and at least a portion of the plug includes threads, the bore threads located on an interior diameter of the bore being mateably compatible with the plug threads located on an exterior diameter of the plug.

3. The attenuating apparatus of claim 2 wherein the threaded plug includes a tuning chamber positioned at its first end in fluid communication with the compressor discharge chamber.

4. The attenuating apparatus of claim 1 wherein the bore is positioned in the housing at an angle of about 90 degrees to the discharge chamber and substantially perpendicular to the direction of compressed gas flow.

5. The attenuating apparatus of claim 1 wherein the plug includes a means for adjusting the plug within the bore.

6. The attenuating apparatus of claim 5 wherein the means for adjusting includes a hex head at the second, opposite end.

7. The attenuating apparatus of claim 5 wherein the means for adjusting includes a socket at the second, opposite end.

8. The attenuating apparatus of claim 1 wherein the preselected position of the plug within the bore provides the bore length that is a ¼ wavelength increment of an undesirable, peak sound produced by the gas discharged by the positive displacement compressor.

9. A compressor system having a noise damping capacity, comprising:

a compressor housing;

a positive displacement compressor housed in the compressor housing, the compressor having a discharge chamber at a compressor discharge port, the discharge chamber receiving compressed gas discharged through the compressor discharge port;

a bore formed in the compressor housing, the bore being positioned at an angle to the compressor discharge chamber and in fluid communication with the discharge chamber;

a plug positioned within the bore, the plug movable after installation within the bore to a preselected position, the plug having a first end in contact with the gas from the compressor discharge chamber and a second, opposite end, the second end being accessible from an exterior of the housing;

a seal positioned between the plug and the bore to seal an interface between the plug and the bore to prevent leakage of the gas from the compressor discharge chamber along the interface;

the plug being lockable within the bore at the preselected position;

wherein a volume of the discharge chamber and a volume of the bore together provide a total discharge volume of the compressor; and wherein the preselected position of the plug within the bore determines the volume of the bore, the preselected position of the plug determining a bore length that attenuates sound from gas pulsations resulting from discharge of compressed gas from the operation of the compressor.

10. The compressor system of claim 9 wherein at least a portion of the bore includes threads and at least a portion of the plug includes threads, the bore threads located on an interior diameter of the bore being mateably compatible with the plug threads located on an exterior diameter of the plug.

11. The compressor system of claim 9 wherein the threaded plug includes a tuning cavity positioned at its first end in fluid communication with the compressor discharge chamber.

12. The compressor system of claim 9 wherein the bore is positioned in the housing at an angle of about 90 degrees to the discharge chamber and substantially perpendicular to the direction of compressed gas flow.

13. The compressor system of claim 9 wherein the plug includes a means for adjusting the plug within the bore.

14. The compressor system of claim 13 wherein the means for adjusting includes a hex head at the second, opposite end.

15. The compressor system of claim 13 wherein the means for adjusting includes a socket at the second, opposite end.

16. The compressor system of claim 9 wherein the preselected position of the plug within the bore provides the bore length that is a ¼ wavelength increment of an undesirable sound produced by the gas discharged by the positive displacement compressor.

17. The compressor system of claim 9 wherein the seal is an o-ring seal.

18. The compressor system of claim 9 wherein the bore further includes a groove for receiving the seal, and the seal is positioned within the groove.

19. The compressor system of claim 9 wherein the plug further includes a groove for receiving the seal, and the seal is positioned within the groove.

20. The compressor system of claim 11 wherein the tuning cavity further includes a passive sound absorptive material.

* * * * *